United States Patent [19]

Nagamoto

[11] 4,283,050

[45] Aug. 11, 1981

[54] RACKET FRAME

[75] Inventor: Itsushi Nagamoto, Hamamatsu, Japan

[73] Assignee: Nippon Gakki Seizo Kabushiki Kaisha, Japan

[21] Appl. No.: 43,159

[22] Filed: May 29, 1979

Related U.S. Application Data

[63] Continuation of Ser. No. 856,091, Nov. 30, 1977, abandoned.

[30] Foreign Application Priority Data

| | | | |
|---|---|---|---|
| Dec. 10, 1976 | [JP] | Japan | 51-147662 |
| Dec. 30, 1976 | [JP] | Japan | 51-160195 |
| Dec. 30, 1976 | [JP] | Japan | 51-160196 |
| Dec. 30, 1976 | [JP] | Japan | 51-160197 |

[51] Int. Cl.[3] ..... A63B 49/02

[52] U.S. Cl. ..... 273/73 K; 273/73 F

[58] Field of Search ..... 273/73 R, 73 C, 73 F, 273/73 K, 82 R, 82 A; 124/23 R

[56] References Cited

U.S. PATENT DOCUMENTS

| | | | |
|---|---|---|---|
| 1,403,143 | 1/1922 | Atwood et al. | 273/73 K X |
| 1,520,109 | 12/1924 | Bishop et al. | 273/82 R |
| 2,064,435 | 12/1936 | Loeffler | 273/82 A X |
| 2,836,529 | 5/1958 | Morris | 124/23 R X |
| 3,166,319 | 1/1965 | Brilhart | 273/73 K X |
| 3,352,566 | 11/1967 | Kennedy | 273/73 K X |
| 3,640,533 | 2/1972 | Davis | 273/73 K X |
| 3,708,380 | 1/1973 | Niebylski | 273/73 K X |
| 3,949,988 | 4/1976 | Staufer | 273/73 F |
| 4,119,313 | 10/1978 | Popplewell et al. | 273/73 K |

FOREIGN PATENT DOCUMENTS

| | | | |
|---|---|---|---|
| 585489 | 2/1947 | United Kingdom | 273/73 K |
| 817405 | 7/1959 | United Kingdom | 273/73 K |

*Primary Examiner*—Richard J. Apley

*Attorney, Agent, or Firm*—Ostrolenk, Faber, Gerb & Soffen

[57] ABSTRACT

A fiber reinforced plastic racket frame advantageously usable for a tennis racket has a head portion accompanied with at least an elongated, relatively thin metallic protective member, which has cut-outs or meshes in the construction, formed integral with the outer surface layer of the fiber reinforced plastic envelope at the racket frame. Protection by this additional member assures enriched frictional resistance and reduced collapse of the head portion and presence of the meshes or cut-outs provides firm anchoring of the protective member to the envelope outer surface layer.

14 Claims, 11 Drawing Figures

RACKET FRAME

This is a continuation of application Ser. No. 856,091, filed Nov. 30, 1977 now abandoned.

BACKGROUND OF THE INVENTION

The present invention relates to an improved racket frame, and more particularly relates to an improved friction and collapse resistant head portion construction of a fiber reinforced plastic racket frame advantageously usable for a tennis racket.

The fiber reinforced plastic tennis racket frame is as one example comprised of a foamed resin core wrapped and covered by a fiber reinforced plastic resin envelope.

The head portion of the racket frame, especially the outer side thereof opposite to the playing face undergoes considerable frictional defacement during long use of the tennis racket. In the case of beginner players, such frictional defacement on the head portion of the racket frame is in general caused by the fact that the players hit the ground of playing courts or nets on the playing court with the head portion of the racket frame by mistake and that the players tend to carelessly lean on the butt end of the grip portion of the racket frame, thereby strongly pressing the head portion against the ground. Whereas, in the case of veteran players, they often try to scoop up balls on the ground using the racket by scraping the ground surface with the head portion of the racket frame. In either cases, the head portion of the racket frame is subjected to repeated frictional damages.

Excessive defacement on the head portion resulted from the above-described repeated frictional damages has significant influence upon the distribution of strength along the oval-shaped portion of the racket frame defining the playing face and the stretch of the strings, especially that of the main or long strings, causes stress concentration upon the defaced head portion which ends in destruction of the racket frame at striking balls. Such defacement on the head portion also leads to enlarged twist of the oval-shaped portion of the racket frame about the long axis of the playing face and this twist greatly hinders ideal provision of repulsive force on the balls to be striken. Poor provision of the repulsive force seriously degrades racket maneuverability and operational accuracy at striking balls.

In the racket construction, neighbouring main or long strings are formed by a single cord which runs parallel to the long axis of the playing face in order to form a main or long string, passes through a hole formed in the head portion, run along the outer periphery of the head portion towards the neighbouring through hole being in tight pressure contact with the outer surface layer of the fiber reinforced plastic envelope, passes through the neighbouring hole and again runs parallel to the long axis of the playing face in order to form the neighbouring main or long string. The above-described portion of the cord in pressure contact with the outer surface layer of the envelope tends to cause collapse of the outer surface layer after long use due to impulsive load repeatedly imposed upon the playing face. The collapse naturally leads to loosening of the strings building up the playing face. Further, in the case of the coreless racket frame, the internal cavity of the racket frame is exposed outside when the envelope is collapsed and this seriously degrades appearance of the racket.

In order to obviate the above-described troubles, it is proposed to couple a separate protector to the head portion of the racket frame. Use of such a protector may somewhat prevent defacement of the racket frame head portion on one hand. However, on the other hand, attachment of such a separate protector increases actual weight of the racket, i.e. the inertia of the racket. Such increased inertia of the racket does not well meet the recently growing demand for light racket which enables speedy tennis. In addition, attachment of such a separate protector is liable to damage beutiful design of the racket frame. Further loose coupling of the protector or loosening in the coupling of the protector after causes generation of noises jar upon the ear at striking balls. This noise trouble may be avoided by firmly coupling the protector to the head portion. But, in actual use, such firmness in the coupling is not coexistent with easiness in the coupling. It should be further noted that use of such a separate protector does no afford any solution to the collapse problem.

SUMMARY OF THE INVENTION

It is one object of the present invention to provide a racket frame having a head portion well resistant against frictional damage.

It is the other object of the present invention to provide a racket frame having a head portion well resistant against collapse by string tension without substantial increase in the weight and damage on the appearance.

In accordance with the present invention, at least an elongated, relatively thin metallic protective member is formed integral with the outer surface layer of the fiber reinforced plastic envelope in the head portion, the protective member being accompanied with meshes, cut-outs or spacings.

In one preferred embodiment of the present invention, the protective member is in the form of a thin network made up of a number of thin metallic wires or strips interlaced to each other.

In another preferred embodiment of the present invention, the protective member is in the form of a thin sheet made up of a number of metallic strips arranged intersecting each other.

In the other preferred embodiment of the present invention, the protective member is given in the form of a thin metallic plate having a number of cut-outs.

In a further preferred embodiment of the present invention, the protective member is given in the form of a thin metallic plate having numerous perforations.

In a further preferred embodiment of the present invention, the protective member is given in the form of a thin resin layer containing numerous metal fibers.

DESCRIPTION OF THE PREFERRED EMBODIMENT

Figure 1:
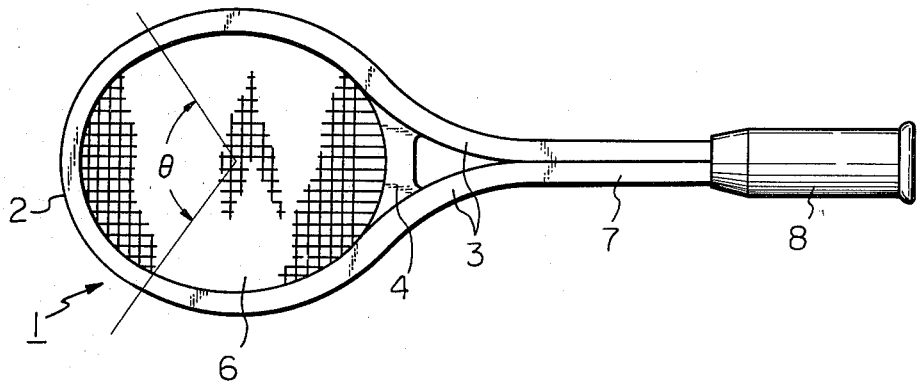
FIG. 1 is a top view of a tennis racket to which the present invention is advantageously applicable.

FIG. 1 generally depicts a tennis racket of a popular type and construction made of fiber reinforced plastics to which the present invention is advantageously applicable.

The racket comprises a racket frame 1 having an approximately oval-shaped or ovaloid head portion terminating in a pair of closely spaced sloping extensions forming a throat portion 3 of the racket. A separate throat piece or yoke 4 is disposed to the inner sides of the sloping frame extensions at the throat portion 3. The oval-shaped portion of the frame 1, including a head portion 2, and the yoke 4 defines a striking area or playing face 6 of the racket which is comprised of main or long strings and cross or short strings, both being in tightly stretched state. The sloping frame extensions are coupled side by side in one body with each other to form a handle or shaft portion 7 of the racket, the end portion of which is encased by a grip portion 8.

In manufacturing of the above-described fiber reinforced plastic racket frame, an elongated core made of foamed synthetic resin is wholly wrapped and covered by a prepreg envelope made of numerous reinforcing fibers preimpregnated with thermosetting resin to prepare an elongated material rod which is then curved and set in position in a mold. The resin is then hardened by application of heat under pressure to obtain a fiber reinforced plastic racket frame such as shown in FIG. 1.

As described already, the racket frame in accordance with the present invention characterised by the head portion thereof accompanied by a protective member or members formed integral to each other.

Figure 2:
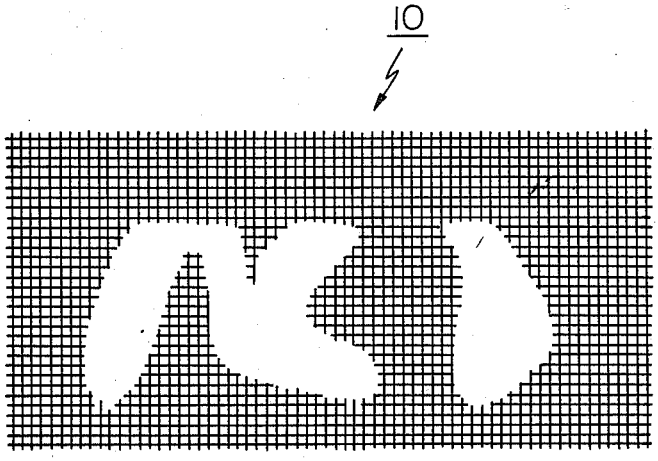
FIG. 2 is a top view of one embodiment of the protective member used in the present invention in an unfolded state.

One example of the protective member used for this purpose is shown in FIG. 2, in which the protective member takes the form of a network 10 made of a number of mutually interlaced metallic wires such as stainless steel wires.

Figure 3A:
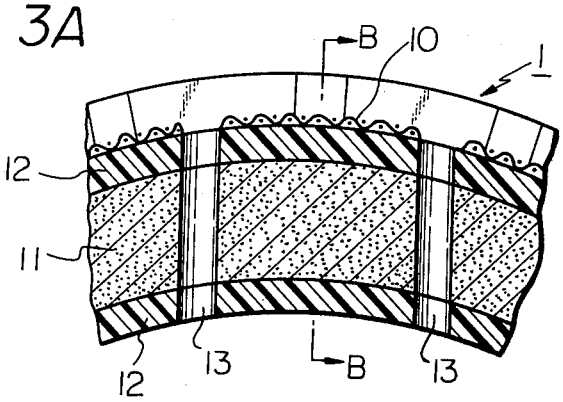
FIG. 3A is a fragmentary cross-section through the head portion of the racket frame in which the protective member shown in FIG. 2 is used.
Figure 3B:
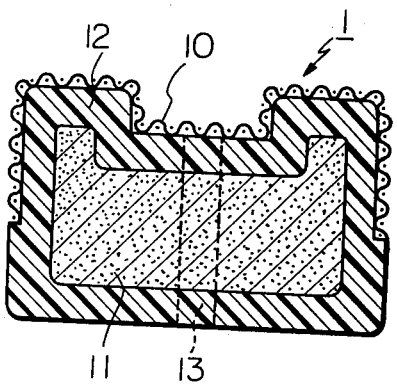
FIG. 3B is a cross-section taken along the line B—B in FIG. 3A.

The protective network 10 is disposed to the head portion 2 of the racket frame in a manner such as, for example, shown in FIGS. 3A and 3B. In the head portion 2, the racket frame 1 is comprised of a core 11 made of a foamed resin and surface layer 12 covering the foamed resin core 11 and made of a fiber reinforced plastic. Holes 13 are formed through the core 11 and the fiber reinforced plastic (hereinafter referred to as FRP) surface layer 12 for passing the strings making up the playing face 6 of the racket. The holes 13 run almost parallel to the playing face 6. The protective network 10 is embedded integrally in the outermost FRP surface layer 12, while being exposed to the outer side of the head portion 2 of the racket frame 1. It is preferable that, as shown in FIG. 3B, the protective network 10 covers at least partly the both side surfaces of the racket frame 1 parallel to the playing face 6. Presence of meshes in the network construction assures smooth flexing of the head portion 2 fortified by the protective network 10 in response to the impact applied to the racket frame via the playing face 6 at striking balls.

Figure 4:
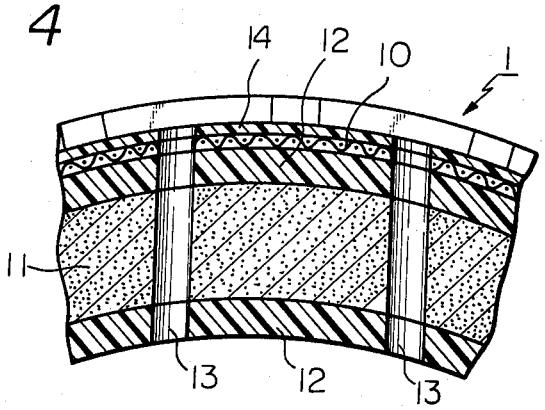
FIG. 4 is a fragmentary cross-section in the head portion of a variant of the racket frame shown in FIG. 3A.

In a variant shown in FIG. 4, the protective network 10 is further covered tightly by an additional FRP surface layer 14, which improves the appearance of the head portion 2 of the racket frame 1.

Figure 5:
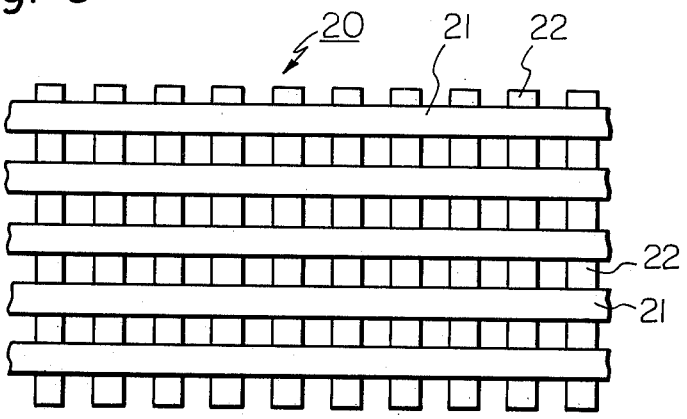
FIG. 5 is a top view of another embodiment of the protective member used in the present invention in an unfolded state.

Another example of the protective member used for the above-described purpose is shown in FIG. 5, in which the protective member takes the form of a thin sheet 20 made of a number of mutually intersecting metallic strips 21 and 22 of a thickness in a range from 0.1 to 0.5 mm. The two groups of metallic strips 21 and 22 may be interlaced also so that the protective sheet 20 is given in the form of a network construction.

Figure 6:
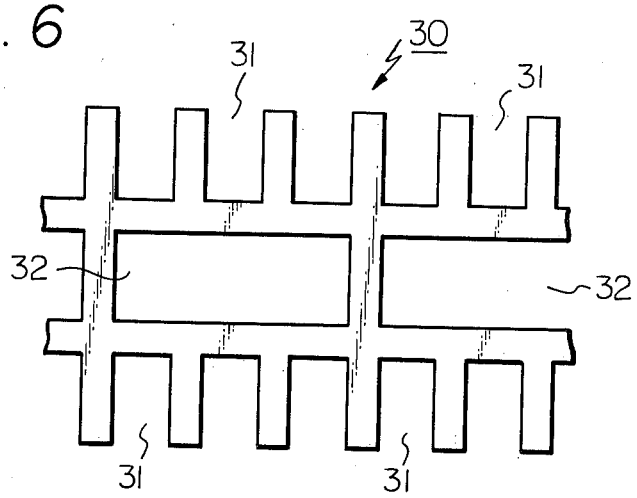
FIG. 6 is a top view of the other embodiment of the protective member used in the present invention in an unfolded state.

The other example of the protective member used for the above-described purpose is shown in FIG. 6, in which the protective member takes the form of a thin metallic strip 30 of a thickness in a range from 0.1 to 0.5 mm. The protective strip 30 has a number of mutually parallel, approximately rectangular end cut-outs 31 opening in both outer fringes and a number of mutually spaced rectangular center cut-outs 32.

When the protective strip 30 is disposed to the head portion 2 of the racket frame 1 as shown in FIG. 3B, the end cut-outs 31 are positioned on or in the side surfaces of the racket frame parallel to the playing face 6 while the center cut-outs 32 are positioned on or in the outer side surface of the racket frame normal to the playing face 6. In the case of this embodiment, the cut-outs are provided so that the head portion 2 of the racket frame fortified by the protective strip 30 can smoothly flexes in response to the impact applied to the racket frame via the playing face 6 at striking balls. In other words, the cut-outs 31 and 32 in the protective strip 30 of the present embodiment function equal to the meshes in the protective network 10 of the preceding embodiment.

Figure 7:
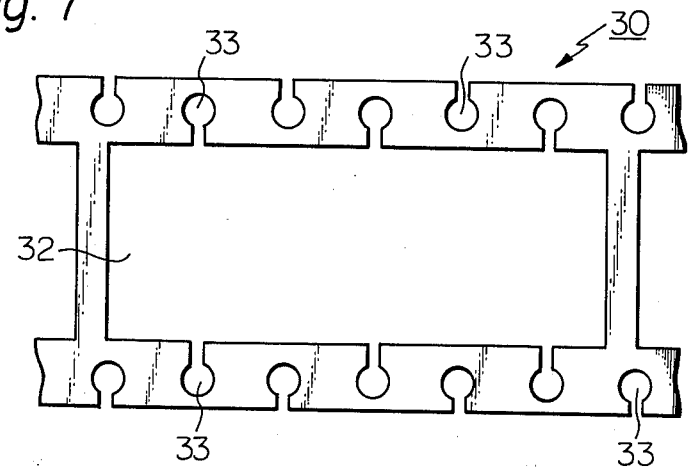
FIG. 7 is a top view of one variant of the protective member shown in FIG. 6 in an unfolded state.

In a variant of the protective strip 30 shown in FIG. 7, two groups of keyhole shaped cut-outs 33 are formed in the thin plate, one group opening in the outer fringes and the other group opening in the rectangular center cut-outs 32. Along the length of the protective strip 30, the cut-outs 33 of the one group and that of the other group are positioned alternately.

Figure 8:
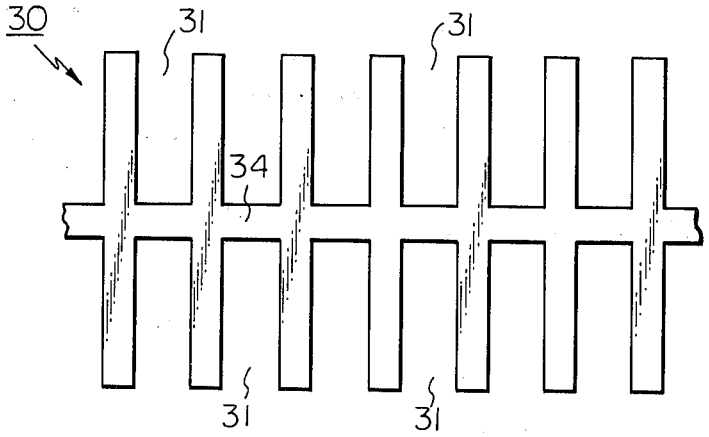
FIG. 8 is a top view of another variant of the protective member shown in FIG. 6 in an unfolded state.

In a further variant of the protective strip shown in FIG. 8, the center cut-outs 32 used in the foregoing protective strips are omitted and the end cut-outs 31 in the embodiment shown in FIG. 6 are elongated towards the center of the strip while leaving a thin center extension 34.

Figure 9:
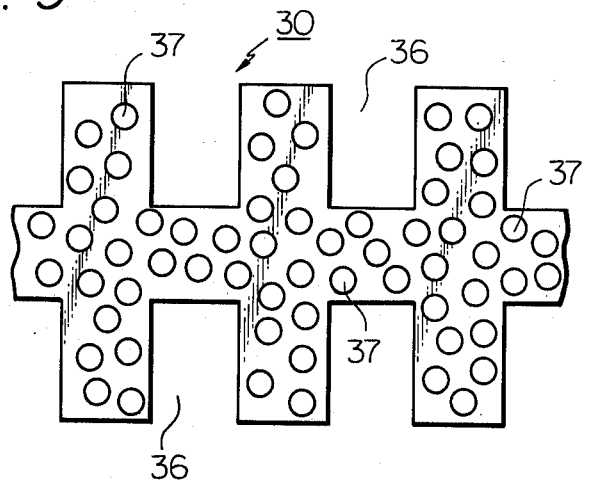
FIG. 9 is a top view of the other variant of the protective member shown in FIG. 6.

A still further variant of the protective strip 30 is shown in FIG. 9, in which the strip 30 is basically similar to that shown in FIG. 8 but is provided with end cut-outs 36 of broader width and numerous perforations 37 formed in the solid remainder thereof. Presence of the numerous perforations 37 in the solid remainder of the protecting strip 30 assures further smoother flexing of the racket frame head portion 2 at striking balls. A further example of the protective member used for the above-described purpose is shown in FIG. 10, in which the protective member takes the form of an additional resin protective layer 40 containing metallic fibers, the protective layer 40 being preferably positioned on the outermost side of the FRP surface layer 12.

The protective member in accordance with the present invention is disposed to the head portion 2 of the racket frame over an area corresponding to the center angle $\theta$ shown in FIG. 1, the center angle $\theta$ generally amounting to about 120 degrees. More concretely, fairly sufficient protection can be obtained when the protective member extends over about 50 cm. along the length of the racket frame including the head portion 2.

In the manufacturing of the racket frame in accordance with the present invention, the protective member such as the one shown in any of FIGS. 2, 5, 6, 7, 8 and 9 is set to the prescribed position of the above-described elongated material rod and then curved and set in position, together with the material rod, in the given mold. During hardening of the thermosetting resin by application of heat under pressure, the protective member is bound or embedded integral with the FRP surface layer. During this process, the thermosetting resin and fortifying fibers preimpregnated therewith get into the meshes and cut-outs in the protective member construction, thereby the protective member being firmly anchored to the FRP surface layer construction.

Figure 10:
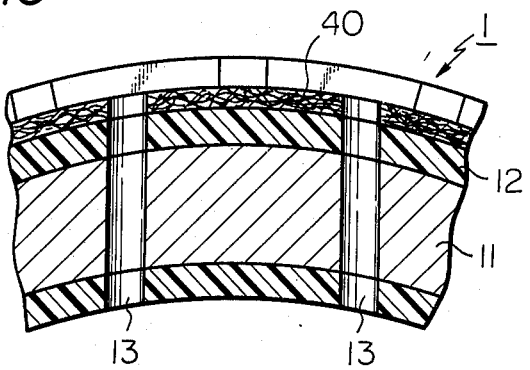
FIG. 10 is a fragmentary cross-section in the head portion of a racket frame in which the other embodiment of the protective member in accordance with the present invention is used.

In the case of the protective member shown in FIG. 10, a metallic fiber cloth or metallic fiber filaments is overlapped or wound around the prepreg envelope and, when necessary, further impregnated with a suitable resin solution. In advance to the overlapping or winding, the metallic fiber cloth or filaments may be preimpregnated with a suitable resin solution.

In accordance with the present invention, a metallic protective member or members are disposed to the racket frame head portion preferably covering the outer side FRP surface layer. This protection remarkably enriches frictional resistance of the racket frame head portion. In addition, the head portion construction mechanically fortified by the metallic protective member excellently resist against load by string tension, thereby successfully preventing undesirable collapse of the FRP surface layer bearing the turning back portion of the stretched string. Presence of the meshes, cut-outs and spacings in the construction of the protective member assures smooth flexing of the head portion at striking balls and strong anchoring of the protective member to the associated FRP surface layer.

I claim:

1. An improved racket frame comprising a generally rounded head portion accompanied by an elongated thin metallic plate formed integrally with a fiber reinforced plastic outer layer of said head portion, said metallic plate including a center extension in the form of first metallic strip means, and elongated branches each also in the form of a respective second metallic strip and extending laterally from and on both sides of said center extension, said center extension being positioned so that its width dimension is substantially normal to the playing faces of said racket and so that it is on the outer side of the curvature of the generally rounded head portion.

2. An improved racket frame as claimed in claim 1 in which said metallic plate is exposed on the outer side of said fiber reinforced plastic outer surface layer.

3. An improved racket frame as claimed in claim 1 in which said metallic plate extends along the length of said racket frame in said head portion over an area corresponding to a center angle amounting to 120 degrees.

4. An improved racket frame as claimed in claim 1 in which said metallic plate takes the form of a thin sheet made of a number of thin strips intersecting each other.

5. An improved racket frame as claimed in claim 1 in which the thickness of said plate is in a range from 0.1 to 0.5 mm.

6. An improved racket frame as claimed in claim 1 in which said center extension is provided with a number of center cut-outs specially aligned in the longitudinal direction of said plate.

7. An improved racket frame as claimed in claim 6 in which said center cut-outs are rectangular in shape.

8. An improved racket frame as claimed in claim 6 further comprising cut-outs opening in said center cut-outs, said cut-outs opening in said fringes and said cut-outs opening in said center cut-outs are arranged alternately in the longitudinal direction of said plate.

9. An improved racket frame as claimed in claim 1, wherein said first metallic strip means comprises a first metallic strip.

10. An improved racket frame as claimed in claim 9, wherein said first metallic strip has a plurality of cutouts through it arranged in a series along the length of said first metallic strip, and each said cutout being surrounded by the material of said first metallic strip.

11. An improved racket frame as claimed in claim 10, wherein said cutouts are rectangular in shape.

12. An improved racket frame as claimed in claim 1, further comprising a plurality of perforations through said metallic plate.

13. An improved racket frame as claimed in claim 12, wherein there are said perforations through both said first metallic strip means and said second metallic strips.

14. An improved racket frame as claimed in any of claims 1, 10 or 13, wherein said elongated branches extend long enough to be in planes substantially parallel to said playing face.

* * * * *